US008213576B2

(12) United States Patent
Tomita et al.

(10) Patent No.: US 8,213,576 B2
(45) Date of Patent: Jul. 3, 2012

(54) X-RAY TUBE APPARATUS

(75) Inventors: Sadamu Tomita, Kyoto (JP); Shigeki Hayashi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 196 days.

(21) Appl. No.: 12/671,021

(22) PCT Filed: Aug. 9, 2007

(86) PCT No.: PCT/JP2007/065645

§ 371 (c)(1),
(2), (4) Date: Jan. 27, 2010

(87) PCT Pub. No.: WO2009/019791

PCT Pub. Date: Feb. 12, 2009

(65) Prior Publication Data

US 2010/0195799 A1 Aug. 5, 2010

(51) Int. Cl.
*H01J 35/30* (2006.01)

(52) U.S. Cl. ..... 378/137; 378/138

(58) Field of Classification Search ..... 378/119, 378/121, 137, 138

See application file for complete search history.

(56) References Cited

U.S. PATENT DOCUMENTS

| | | | | |
|---|---|---|---|---|
| 4,819,260 | A | 4/1989 | Haberrecker | |
| 4,993,055 | A * | 2/1991 | Rand et al. | 378/125 |
| 5,105,456 | A | 4/1992 | Rand et al. | |
| 5,883,936 | A | 3/1999 | Hell et al. | |
| 6,181,771 | B1 | 1/2001 | Hell et al. | |

FOREIGN PATENT DOCUMENTS

| | | | |
|---|---|---|---|
| DE | 196 31 899 | A1 | 2/1998 |
| DE | 19820243 | A1 | 11/1999 |
| JP | 62-92554 | U | 6/1987 |
| JP | 4-138645 | A | 5/1992 |
| JP | 10-69889 | A | 3/1998 |

OTHER PUBLICATIONS

Supplementary European Search Report for the Application No. EP 07 79 2295 dated Mar. 18, 2011.
International Search Report for the Application No. PCT/JP2007/065645 mailed Nov. 13, 2007.
Notification of Reasons for Refusal for the Application No. 2009-526318 from Japan Patent Office mailed Nov. 22, 2011.
Partial European Search Report for the Application No. EP 12 15 0632 dated Apr. 5, 2012.

* cited by examiner

*Primary Examiner* — Courtney Thomas
(74) *Attorney, Agent, or Firm* — Cheng Law Group, PLLC

(57) ABSTRACT

Conventionally, the magnetic field generator was arranged perpendicularly to the axis of the electron beam. The magnetic field generator of this invention is arranged so as to be inclined relative to the plane perpendicular to the axis of the electron beam. Specifically, the magnetic field generator is arranged so as to be inclined relative to the plane perpendicular to the axis of the electron beam within the range in the cathode side from the focused and deflected electron beam. Inclination up to the anode side opposite to the cathode side will lead to a possibility of increasing the reduced X-ray source diameter. Thus, arranging the magnetic field generator so as to be inclined within the range in the cathode side from the electron beam may reduce the X-ray source diameter.

7 Claims, 5 Drawing Sheets

(a)

(b)

(c)

X-RAY TUBE APPARATUS

TECHNICAL FIELD

This invention relates to an X-ray tube apparatus. More particularly, this invention is directed to an X-ray tube, such as an X-ray tube of a system that an anode rotates together with an enclosure, in which an electron beam is focused and deflected by a magnetic field generator, typified by a quadrupole magnetic field lens etc., to collide against a target.

BACKGROUND ART

Conventional X-ray tube apparatus include an enclosure rotation type X-ray tube apparatus in which an anode rotates together with an enclosure, and an electron beam from an electron source of a cathode provided about an axis in the X-ray tube is focused and deflected by a magnetic field generator provided out of the X-ray tube to form a focal spot in a predetermined position on a target disk of the anode (see, for example, patent document 1). The magnetic field generator of this type provided in the enclosure rotation type X-ray tube apparatus is formed of a coil and yoke. The generator generates a focusing magnetic field for focusing an electron beam, and may also generate a deflection magnetic field superimposed thereon for deflecting the electron beam. Such magnetic field generators include, for instance, a quadrupole magnetic field lens and an octupole magnetic field lens. Accordingly, the electron beam may be focused and deflected to form a focal spot in a predetermined position on the target disk of the anode. Moreover, rotation of the anode will avoid concentrated collision of the focused and deflected electron beam in a same position on the target disk. Consequently, heat generated due to collision of the electron beam will not be concentrated in the same position on the target disk, leading to prevention of the target disk from being molten. Furthermore, the heat generated due to the collision of the electron beam is dissipated from the target integrated into the enclosure out of the X-ray tube through heat conduction, which may realize an improved cooling efficiency in the X-ray tube and successive irradiation with X-rays without any necessity of a cooling time.

[Patent Document 1]
U.S. Pat. No. 5,883,936

DISCLOSURE OF THE INVENTION

Problem to be Solved by the Invention

However, the X-ray tube apparatus of this type has a problem that, since the focal spot is formed in the predetermined position on the target by deflecting the electron beam, a diameter of the spot colliding against the anode (focal spot size), i.e., an X-ray source diameter, cannot be reduced.

This invention has been made regarding the state of the art noted above, and its object is to provide an X-ray tube apparatus capable of reducing an X-ray source diameter.

Means for Solving the Problem

To fulfill the above object, Inventors have made intensive research and attained the following findings.

That is, even though operation is performed to control conditions of the electron beam, such as magnetomotive force given by a product of current fed through the magnetic field generator and a number of turns of a coil or voltages applied to the cathode and the anode, there is a limit to reduction of the X-ray source diameter. Then, an idea on operating control conditions of the electron beam has been changed, and an attention is given to modifying of a structure itself of the X-ray tube apparatus. For instance, the magnetic field generator, which is parallel to a plane perpendicular to an axis of the electron beam, i.e., perpendicular to the axis of the electron beam, is made so as to be inclined relative to the plane perpendicular to the axis of the electron beam. FIG. 2(*a*) is a graph of variations in an inclination angle and the focal spot size in accordance with it. FIG. 2(*b*) is a simulation result of the focal spot size where the magnetic field generator was not inclined. FIG. 2(*c*) is a simulation result of the focal spot size where the magnetic field generator was inclined. Herein, the focal spot size varies under various conditions. Thus, it should be noted that the focal spot size of FIG. 2 is data for reference.

As is also apparent from FIG. 2(*b*), where the magnetic field generator was not inclined, the focal spot size had a length in a transverse direction $L_1$ of 0.59 mm and a width in a longitudinal direction $L_2$ of 0.71 mm. On the other hand, as is apparent from FIG. 2(*c*), where the magnetic field generator was inclined at 25 degrees relative to the plane perpendicular to the axis of the electron beam, the focal spot size had a length in a transverse direction $L_1$ of 0.48 mm and a width in a longitudinal direction $L_2$ of 0.39 mm. Particularly, the width in the longitudinal direction $L_2$ where the magnetic field generator was inclined at 25 degrees may be reduced in size to be around half the width in the longitudinal direction where the magnetic field generator was not inclined. From this, it may be assumed that inclination relative to the plane perpendicular to the axis of the electron beam leads to a reduced width in a projection direction, i.e., the width in the longitudinal direction $L_2$. As illustrated in FIG. 2(*a*), it is actually confirmed that when the inclination angle varies, the focal spot size (in the width in the longitudinal direction $L_2$) becomes smaller as the inclination angle becomes larger. Consequently, from the results of FIG. 2, the finding has been obtained that the X-ray source diameter may be reduced by arranging the magnetic field generator so as to be inclined relative to the plane perpendicular to the axis of the electron beam.

This invention based on the above finding adopts the following configuration. An X-ray tube apparatus of this invention is an X-ray tube apparatus to generate X-rays, including a cathode to generate an electron beam, a magnetic field generator to generate a magnetic field for focusing and deflecting the electron beam from the cathode, an anode to generate X-rays upon collision of the electron beam focused and deflected by the magnetic field generator, and an enclosure to accommodate the cathode and the anode inside thereof and rotate together with the anode, in which the magnetic field generator is arranged so as to be inclined relative to a plane perpendicular to an axis of the electron beam.

According to the X-ray tube apparatus of this embodiment, the X-ray source diameter may be reduced by arranging the magnetic field generator so as to be inclined relative to the plane perpendicular to the axis of the electron beam.

In the X-ray tube apparatus of the foregoing embodiment, the magnetic field generator is preferably arranged so as to be inclined relative to the plane perpendicular to the axis of the electron beam within a range in a cathode side from the focused and deflected electron beam. Inclination of the generator up to a side opposite to the cathode side (i.e., the anode side) will lead to a possibility of increasing the reduced X-ray source diameter. Thus, inclination is preferable within the cathode side. An inclination angle of the magnetic field generator is set in accordance with the X-ray source diameter (focal spot size) required. In other words, the magnetic field generator is arranged so as to be inclined relative to the plane perpendicular to the axis of the electron beam until a desired X-ray source diameter may be obtained. For instance, where the X-ray source diameter (focal spot size) of 0.4 mm is required, the angle of the magnetic field generator is set so as to be the X-ray source diameter of 0.4 mm. Particularly, the magnetic field generator is preferably arranged so as to be inclined relative to the plane perpendicular to the axis of the electron beam until the X-ray source diameter is reduced by 50% compared to the magnetic field generator that is not inclined.

Moreover, an X-ray tube apparatus according to another embodiment than above is an X-ray tube apparatus to generate X-rays, including a cathode to generate an electron beam, a magnetic field generator to generate a magnetic field for focusing and deflecting the electron beam from the cathode, an anode to generate X-rays upon collision of the electron beam focused and deflected by the magnetic field generator, and an enclosure to accommodate the cathode and the anode inside thereof and rotate together with the anode, in which a distribution angle of a magnetic pole that is formed by each of the magnetic pole of the magnetic field generator is made to be asymmetrical relative to a deflection direction of the electron beam.

According to the X-ray tube apparatus of this embodiment, the X-ray source diameter may be reduced by making the distribution angle of the magnetic pole that is formed by each magnetic pole of the magnetic field generator to be asymmetrical relative to the deflection direction of the electron beam.

Moreover, an X-ray tube apparatus according to another embodiment than the above is an X-ray tube apparatus to generate X-rays, including a cathode to generate an electron beam, a magnetic field generator to generate a magnetic field for focusing and deflecting the electron beam from the cathode, an anode to generate X-rays upon collision of the electron beam focused and deflected by the magnetic field generator, and an enclosure to accommodate the cathode and the anode inside thereof and rotate together with the anode, in which a length of each magnetic pole of the magnetic field generator is made to be asymmetrical relative to the deflection direction of the electron beam.

According to the X-ray tube apparatus of this embodiment, the X-ray source diameter may be reduced by making the length of each magnetic pole of the magnetic field generator to be asymmetrical relative to the deflection direction of the electron beam.

Furthermore, an X-ray tube apparatus according to another embodiment than the above is an X-ray tube apparatus to generate X-rays, including a cathode to generate an electron beam, a magnetic field generator to generate a magnetic field for focusing and deflecting the electron beam from the cathode, an anode to generate X-rays upon collision of the electron beam focused and deflected by the magnetic field generator, and an enclosure to accommodate the cathode and the anode inside thereof and rotate together with the anode, in which magnetomotive force to excite the magnetic pole of the magnetic field generator is set to be asymmetrical relative to the deflection direction of the electron beam.

According to the X-ray tube apparatus of this embodiment, the X-ray source diameter may be reduced by setting the magnetomotive force to excite the magnetic poles of the magnetic field generator to be asymmetrical relative to the deflection direction of the electron beam.

Effect of the Invention

With the X-ray tube apparatus of this invention, the X-ray source diameter may be reduced by arranging the magnetic field generator so as to be inclined relative to the plane perpendicular to the axis of the electron beam, by making the distribution angle of the magnetic pole that is formed by each magnetic pole of the magnetic field generator asymmetrical relative to the deflection direction of the electron beam, by making the length of each of the magnetic pole of the magnetic field generator asymmetrical relative to the deflection direction of the electron beam, or by setting the magnetomotive force to excite the magnetic pole of the magnetic field generator to be asymmetrical relative to the deflection direction of the electron beam.

BRIEF DESCRIPTION OF THE DRAWINGS

FIG. 1(*b*) is a schematic elevation view of a magnetic field generator of the X-ray tube apparatus according to Embodiment 1;

FIG. 2(*b*) is a simulation result of the focal spot size where the magnetic field generator is not inclined;

FIG. 2(*c*) is a simulation result of the focal spot size where the magnetic field generator is inclined;

DESCRIPTION OF REFERENCES

2 . . . cathode
4 . . . magnetic field generator
5 . . . anode
6 . . . enclosure
B . . . electron beam
O . . . axis of electron beam
V . . . plane perpendicular to axis of electron beam

Embodiment 1

Figure 1:
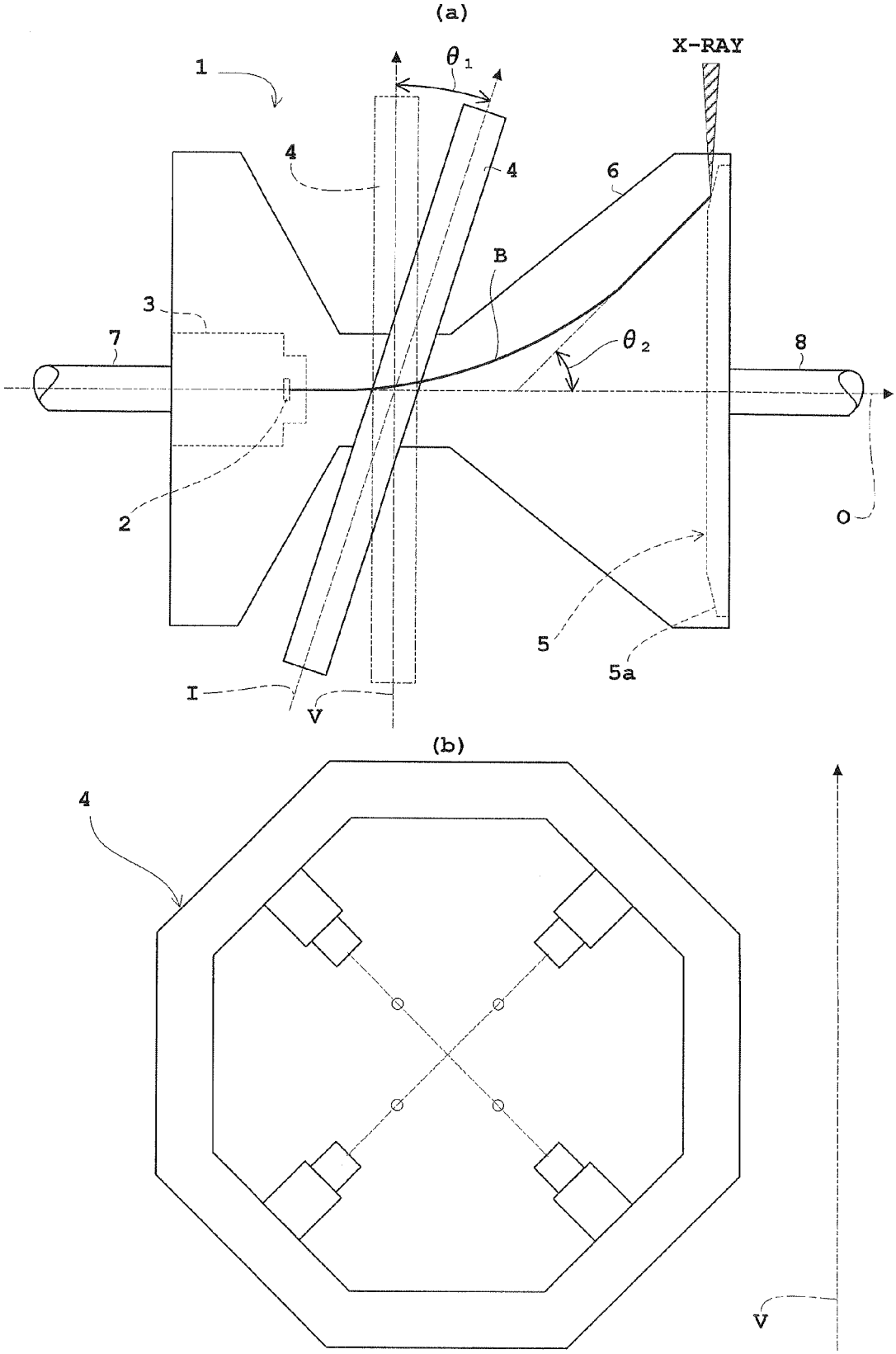
FIG. 1(*a*) is a schematic side view of an X-ray tube apparatus according to Embodiment 1.

Embodiment 1 of this invention will be described in detail hereinafter with reference to the drawings. FIG. 1(*a*) is a schematic side view of an X-ray tube apparatus according to Embodiment 1. FIG. 1(*b*) is a schematic elevation view of a magnetic field generator of the X-ray tube apparatus according to Embodiment 1.

As illustrated in FIG. 1(*a*), an enclosure rotation type X-ray tube apparatus 1 according to Embodiment 1 includes a cathode 2 to generate an electron beam B, a cylindrical electrode 3 with the cathode 2 attached in a groove thereof, a magnetic field generator 4 to generate a magnetic field for focusing and deflecting the electron beam B from the cathode 2, an anode 5 to generate X-rays upon collision of the electron beam B focused and deflected by the magnetic field generator 4, and an enclosure 6 to accommodate the cathode 2, the cylindrical electrode 3, and the anode 5 inside thereof, and rotate together with the anode 5. The cathode 2 corresponds to the cathode of this invention. The magnetic field generator 4 corresponds to the magnetic field generator of this invention. The anode 5 corresponds to the anode of this invention. The enclosure 6 corresponds to the enclosure of this invention.

The cylindrical electrode 3 is arranged together with the cathode 2 about the axis O of the electron beam B. The cathode 2 is composed of a filament, such as a filament formed from tungsten. When heated to high temperatures, the filament emits a thermal electron to generate the electron beam B. The cathode 2 is exemplified by a field emission type that emits the electron beam by the tunnel effect with the electric field, other than a thermo-electronic emission type represented by the filament, etc. Thus, the types of cathode 2 are not particularly limited.

As illustrated in FIG. 1(*b*), the magnetic field generator 4 is formed of a polygonal (octagonal in FIG. 1(*b*)) yoke, and coils winding around a plurality of iron cores extending toward a center. The yoke is formed of a magnetic material such as iron.

Conventionally, the magnetic field generator 4 was arranged, as illustrated by a long dashed double-short dashed line in FIG. 1(*a*), so as to be parallel to a plane V perpendicular to the axis O of the electron beam B, i.e., perpendicular to the axis O of the electron beam B. In contrast, the magnetic field generator 4 of Embodiment 1 is arranged, as illustrated in FIG. 1(*a*), so as to be inclined at an inclination angle $\theta_1$ relative to the plane V perpendicular to the axis of the electron beam B. A symbol I is given to the axis of the inclined magnetic field generator 4.

The magnetic field generator 4 is preferably arranged so as to be inclined relative to the plane V perpendicular to the axis O of the electron beam B within a range in a cathode 2 side from the focused and deflected electron beam B. Inclination up to a side opposite to the cathode 2 side (i.e., the anode 5 side) will lead to a possibility of increasing the reduced X-ray source diameter. Thus, inclination is preferable within the cathode 2 side. Let the angle that is formed between the axis O of the electron beam B and the electron beam B focused and deflected be denoted as an inclination angle $\theta_2$. In Embodiment 1, the electron beam B is focused and deflected at the inclination angle $\theta_2$ of approximately 40 degrees. Thus, if it is assumed that the inclination angle $\theta_1$ satisfies $\theta_1=90°-\theta_2$ at maximum, the magnetic field generator 4 may be inclined relative to the plane V perpendicular to the axis O of the electron beam B at the inclination angle of 50 degrees (=90°−40°) at maximum. Consequently, the magnetic field generator 4 may be inclined within the range to the cathode 2 side without being inclined up to an opposite side to the cathode 2 side by arranging the magnetic field generator 4 so as to be inclined relative to the plane V perpendicular to the axis O of the electron beam B at an range of 0 degree to 50 degrees.

Such angle $\theta_1$ at which the magnetic field generator 4 is inclined may be set according to the required X-ray source diameter (focal spot size). That is, the magnetic field generator 4 is arranged so as to be inclined relative to the plane V perpendicular to the axis O of the electron beam B until the desired X-ray source diameter may be obtained. For instance, where the X-ray source diameter (focal spot size) of 0.4 mm is required, the angle $\theta_1$ of the magnetic field generator 4 is set so as to be the X-ray source diameter (focal spot size) of 0.4 mm. Particularly, the magnetic field generator 4 is preferably arranged so as to be inclined relative to the plane V perpendicular to the axis O of the electron beam B until the X-ray source diameter is reduced by 50% compared to the magnetic field generator 4 that is not inclined. Taking FIG. 2(*b*) or 2(*c*) mentioned above as an example, the width in the longitudinal direction $L_2$ where the magnetic field generator 4 is inclined at 25 degrees as illustrated in FIG. 2(*c*) may be reduced in size to be around half the width where the magnetic field generator 4 is not inclined as illustrated in FIG. 2(*b*).

The anode 5 is arranged inside the enclosure 6 so as to be integrated with the enclosure 6. The anode 5 has a bevel target portion 5*a*. The focused and deflected electron beam B accelerates towards the anode 5 due to the high voltage electric field, and collides with the bevel target portion 5*a*, thereby generating X-rays. The enclosure 6 is evacuated. The enclosure 6 has a cathode side rotation axis 7 on the cathode 2 side and an anode side rotation axis 8 on the anode 5 side. The enclosure 6 rotates together with the anode 5 by rotating both the rotation axes 7 and 8.

Figure 2:
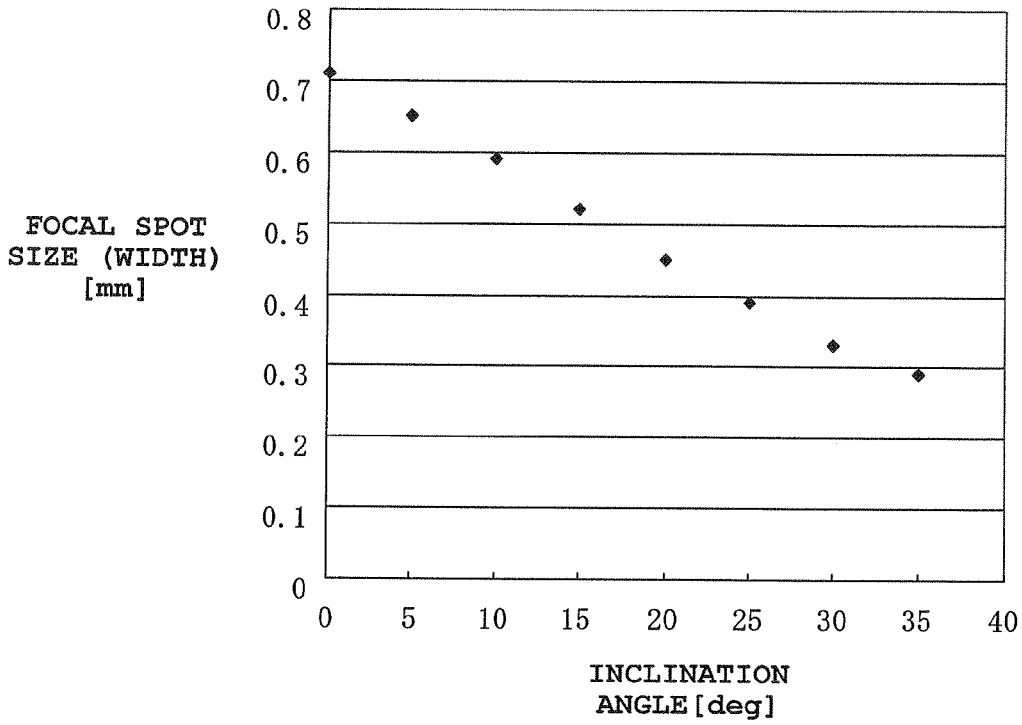
FIG. 2(*a*) shows a graph of variations in an inclination angle and a focal spot size in accordance with the inclination angle.
Figure 2:
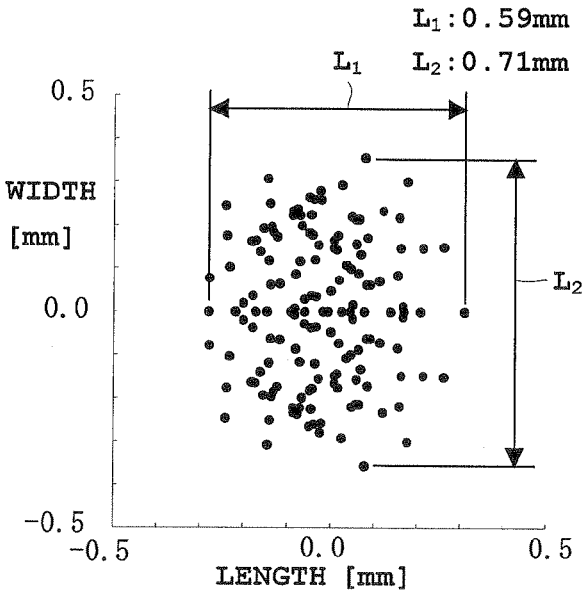
Figure 2:
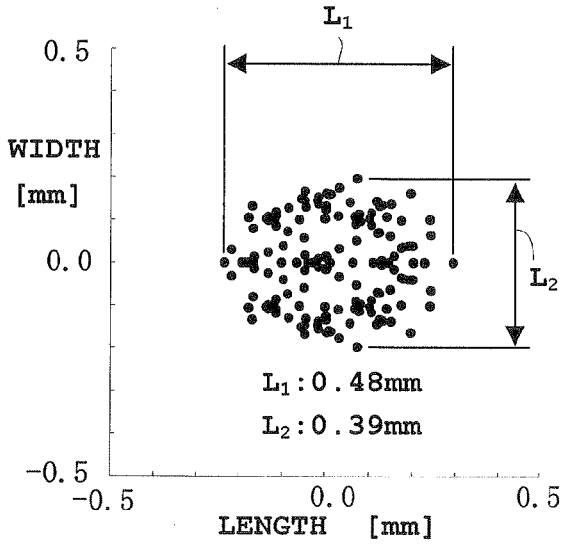

According to the X-ray tube apparatus 1 of Embodiment 1, the X-ray source diameter (focal spot size) may be reduced as illustrated in FIGS. 2(*a*) and 2(*b*) by arranging the magnetic field generator 4 so as to be inclined relative to the plane V perpendicular to the axis O of the electron beam B (in a range of 0 degree to 50 degrees in Embodiment 1).

Here, as illustrated in FIG. 1(*b*) in Embodiment 1, the distribution angle of the magnetic pole that is formed by each of the magnetic pole of the magnetic field generator 4 is made to be symmetrical relative to the deflection direction of the electron beam B (corresponding to the plane V perpendicular to the axis of the electron beam B), and the length of each magnetic pole of the magnetic field generator 4 is made to be symmetrical relative to the deflection direction of the electron beam B. Instead, use may be made of the magnetic field generator 4 as Embodiment 2 mentioned below in which the distribution angle of the magnetic pole is made to be asymmetrical relative to the deflection direction of the electron beam B, the magnetic field generator 4 as Modification (2) mentioned below in which the length of each magnetic pole is made to be asymmetrical relative to the deflection direction of the electron beam B, or the magnetic field generator 4 in which the distribution angle of the magnetic pole is made to be asymmetrical relative to the deflection direction of the electron beam B as in Embodiment 2 and the length of each magnetic pole is made to be asymmetrical relative to the deflection direction of the electron beam B as in Modification (2). Such magnetic field generator 4 may be arranged so as to be inclined relative to the plane V perpendicular to the axis O of the electron beam B. In other words, Embodiment 1 may be combined with Embodiment 2 or Modification (2). In addition, the magnetic field generator 4 in which magnetomotive force to excite the magnetic poles of the magnetic field generator 4 is set to be asymmetrical relative to the deflection direction of the electron beam B may be arranged so as to be inclined relative to the plane V perpendicular to the axis O of the electron beam B, as in Modification (3) mentioned below.

Embodiment 2

Figure 3:
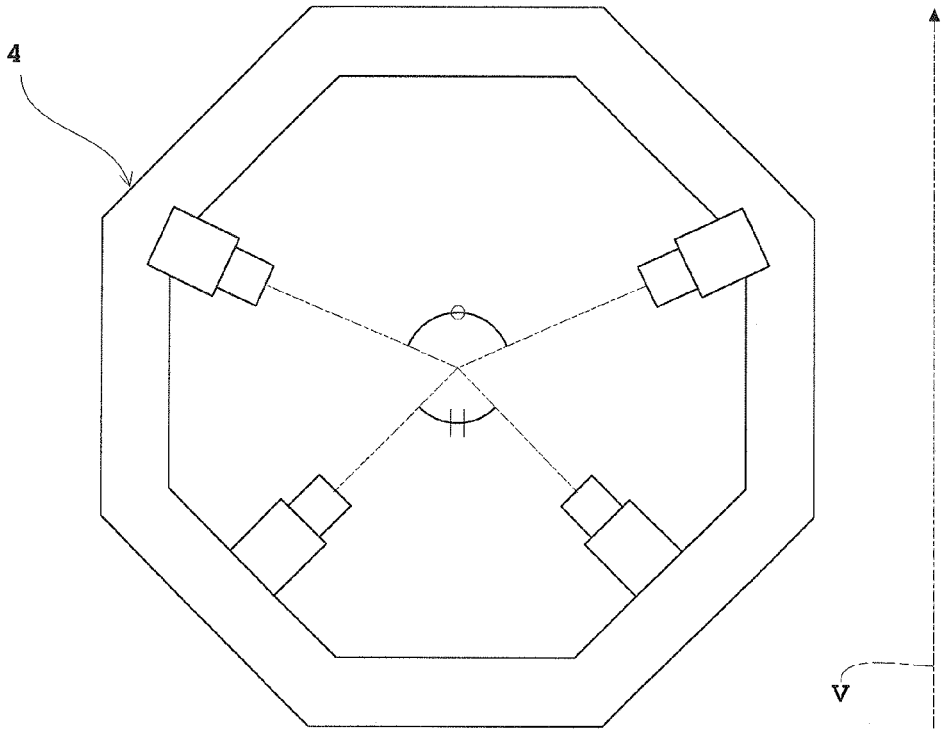
FIG. 3 is a schematic elevation view of the magnetic field generator of the X-ray tube apparatus according to Embodiment 2.

Now, Embodiment 2 of this invention will be described in detail hereinafter with reference to the drawings. FIG. 3 is a schematic elevation view of the magnetic field generator of the X-ray tube apparatus according to Embodiment 2.

In Embodiment 2, the distribution angle of the magnetic pole that is formed by each of the magnetic pole 4 of the magnetic field generator is made to be asymmetrical relative to the deflection direction of the electron beam B (i.e., the plane V perpendicular to the axis of the electron beam B) (see "○" and "‖" in FIG. 3). Here, in the X-ray tube apparatus 1 of Embodiment 2 (see FIG. 1(*a*)), the magnetic field generator 4 may be arranged so as to be inclined at the inclination angle $\theta_1$ relative to the plane V perpendicular to the axis of the electron beam B as Embodiment 1 mentioned above. Alternatively, as illustrated in the long dashed double-short dashed line in FIG. 1(*a*), the magnetic field generator 4 may be arranged so as to be parallel to the plane V perpendicular to the axis O of the electron beam B, i.e., perpendicular to the axis O of the electron beam B.

That is, in Embodiment 2, with the distribution angle of the magnetic pole of the magnetic field generator 4 made to be asymmetrical relative to the deflection direction of the electron beam B (the plane V perpendicular to the axis of the electron beam B), the magnetic field generator 4 may be arranged so as to be inclined relative to the plane V perpendicular to the axis O of the electron beam B, or may be arranged so as not to be inclined but to be parallel. In addition, where the magnetic field generator 4 is arranged so as to be inclined at the inclination angle $\theta_1$ relative to the plane V perpendicular to the axis of the electron beam B as in Embodiment 1 mentioned above, the magnetic field generator 4 as in Embodiment 2 is to be used, instead of the magnetic field generator 4 in Embodiment 1, in which the distribution angle of the magnetic pole is made to be asymmetrical in the deflection direction of the electron beam B. As a result, combination of Embodiments 1 and 2 is to be realized.

According to the X-ray tube apparatus 1 of Embodiment 2, the X-ray source diameter (focal spot size) may be reduced by making each magnetic pole of the magnetic field generator 4 to be asymmetrical relative to the deflection direction of the electron beam B.

This invention is not limited to the foregoing embodiments, but may be modified as follows.

(1) This invention is applicable to an apparatus for industry use such as a non-destructive inspecting apparatus, or a medical apparatus such as an X-ray diagnostic apparatus.

Figure 4:
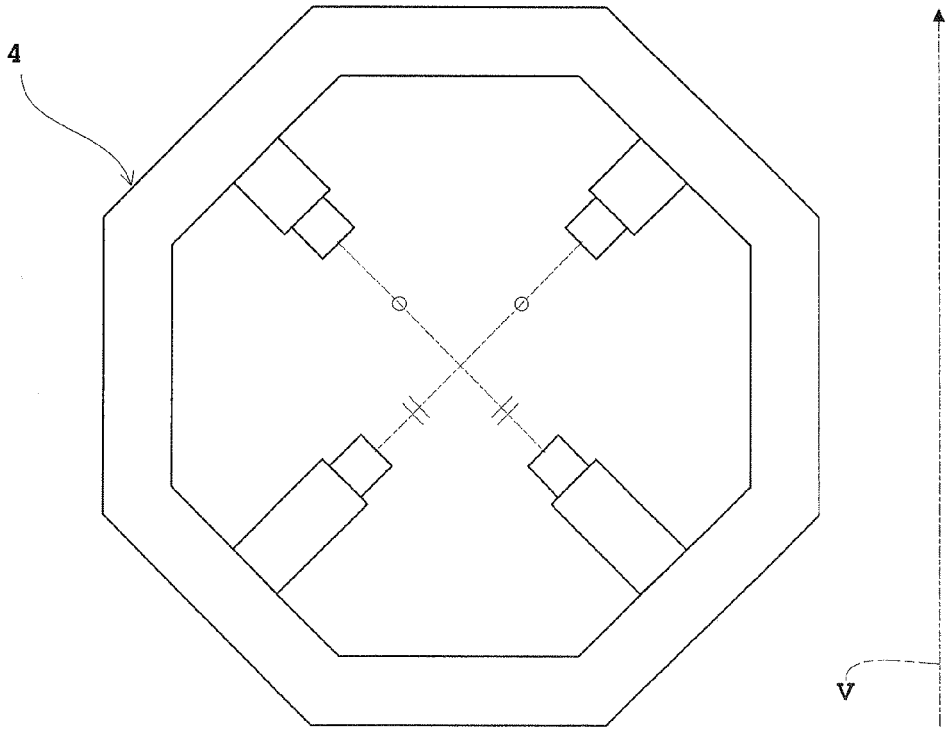
FIG. 4 is a schematic elevation view of the magnetic field generator of the X-ray tube apparatus according to one modification.

(2) In the above Embodiment 1, the magnetic field generator 4 is arranged so as to be inclined relative to the plane V perpendicular to the axis of the electron beam B. In the above Embodiment 2, the distribution angle of the magnetic pole of the magnetic field generator 4 is made to be asymmetrical in the deflection direction of the electron beam B. As illustrated in FIG. 4, the length of each magnetic pole of the magnetic field generator 4 may also be made to be asymmetrical relative to the deflection direction of the electron beam B (i.e., the plane V perpendicular to the axis of the electron beam B) (see "○" and "‖" in FIG. 4).

As also described in Embodiment 2, the magnetic field generator 4 as in the above Embodiment 1 may be arranged so as to be inclined at the inclination angle $\theta_1$ relative to the plane V perpendicular to the axis of the electron beam B. Moreover, as illustrated in the long dashed double-short dashed line in FIG. 1(*a*), the magnetic field generator 4 may be arranged parallel to the plane V perpendicular to the axis O of the electron beam B, i.e., perpendicular to the axis O of the electron beam B. Where the magnetic field generator 4 is arranged so as to be inclined at the inclination angle $\theta_1$ relative to the plane V perpendicular to the axis of the electron beam B as in Embodiment 1 mentioned above, the magnetic field generator 4 as in Modification (2) is to be used, instead of the magnetic field generator 4 in Embodiment 1, in which the length of each magnetic pole of the magnetic field generator 4 is made to be asymmetrical relative to the deflection direction of the electron beam B. As a result, combination of Embodiment 1 and Modification (2) is to be realized. According to the X-ray tube apparatus 1 of Modification (2), the X-ray source diameter (focal spot size) may be reduced by making the length of each magnetic pole of the magnetic field generator 4 to be asymmetrical relative to the deflection direction of the electron beam B.

(3) In the above Embodiment 1, the magnetic field generator 4 is arranged so as to be inclined relative to the plane V perpendicular to the axis of the electron beam B. In the above Embodiment 2, the distribution angle of the magnetic pole of the magnetic field generator 4 is made to be asymmetrical relative to the deflection direction of the electron beam B. Magnetomotive force to excite the magnetic pole of the magnetic field generator 4 may also be set so as to be asymmetrical relative to the deflection direction of the electron beam B (i.e., the plane V perpendicular to the axis of the electron beam B). As mentioned above, magnetomotive force is a product of the current fed through the magnetic field generator 4 and the number of turns of the coil on the magnetic pole of the magnetic field generator 4.

Figure 5:
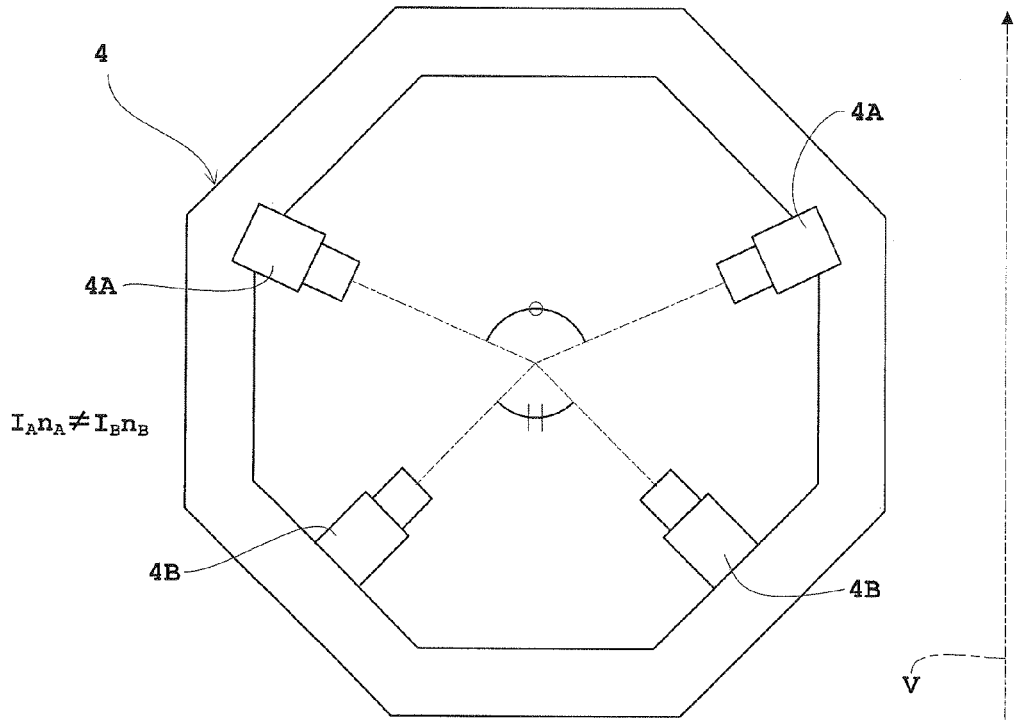
FIG. 5 is a schematic elevation view of the magnetic field generator of the X-ray tube apparatus according to another modification.
Figure 6:
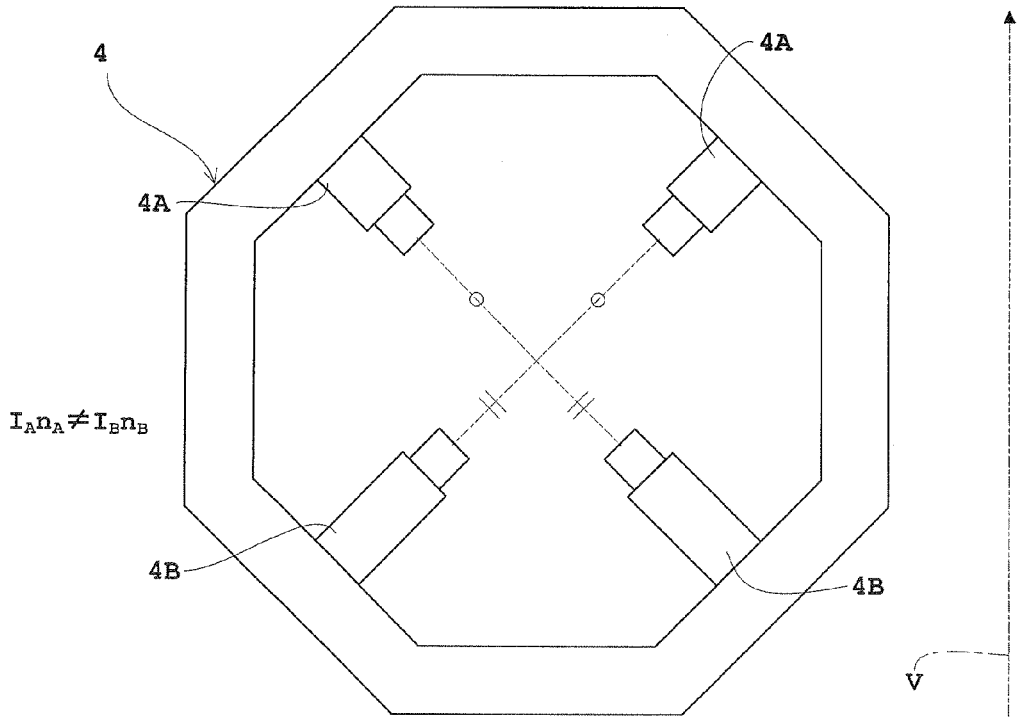
FIG. 6 is a schematic elevation view of the magnetic field generator of the X-ray tube apparatus according to another modification.

For example, as illustrated in FIGS. 5 and 6, the magnetic pole of the magnetic field generator 4 is separated into magnetic poles 4A and 4B in to the deflection direction of the electron beam B. Let the current fed through the magnetic pole 4A be denoted as $I_A$, and the current fed through the magnetic pole 4B as $I_B$. As also illustrated in FIGS. 5 and 6, let the number of turns of the lead wire around the iron core of the coil of the magnetic pole 4A be noted as $n_A$, and the number of turns of the lead wire around the iron core of the coil of the magnetic pole 4B as $n_B$, where assume that $I_A n_A \neq I_B n_B$. Moreover, use may be made of the magnetic field generator 4 in which the distribution angle of the magnetic pole is asymmetrical relative to the deflection direction of the electron beam B, as illustrated in FIG. 5 in combination with the above Embodiment 2, to satisfy $I_A n_A \neq I_B n_B$. Furthermore, use may be made of the magnetic field generator 4 in which the length of each magnetic pole is made to be asymmetrical relative to the deflection direction of the electron beam B, as illustrated in FIG. 6 in combination with the above Modification (2), to satisfy $I_A n_A \neq I_B n_B$.

As also described in Embodiment 2 and Modification (2), the magnetic field generator 4 as in the above Embodiment 1 may be arranged so as to be inclined at the inclination angle $\theta_1$ relative to the plane V perpendicular to the axis of the electron beam B. Moreover, as illustrated in the long dashed double-short dashed line in FIG. 1(*a*), the magnetic field generator 4 may be arranged parallel to the plane V perpendicular to the axis O of the electron beam B, i.e., perpendicular to the axis O of the electron beam B. Where the magnetic field generator 4 is arranged so as to be inclined at the inclination angle $\theta_1$ relative to the plane V perpendicular to the axis of the electron beam B as in Embodiment 1 mentioned above, the magnetic field generator 4 as in Modification (3) is to be used in which the magnetomotive force to excite the magnetic pole is set asymmetrical relative to the deflection direction of the electron beam B, instead of the magnetic field generator 4 in Embodiment 1. Thus, combination of Embodiment 1 and Modification (3) is to be recognized. According to the X-ray tube apparatus 1 of this Modification (3), the X-ray source diameter (focal spot size) may be reduced by setting the magnetomotive force to excite the magnetic poles of the magnetic field generator 4 to be asymmetrical relative to the deflection direction of the electron beam B.

Figure 7:
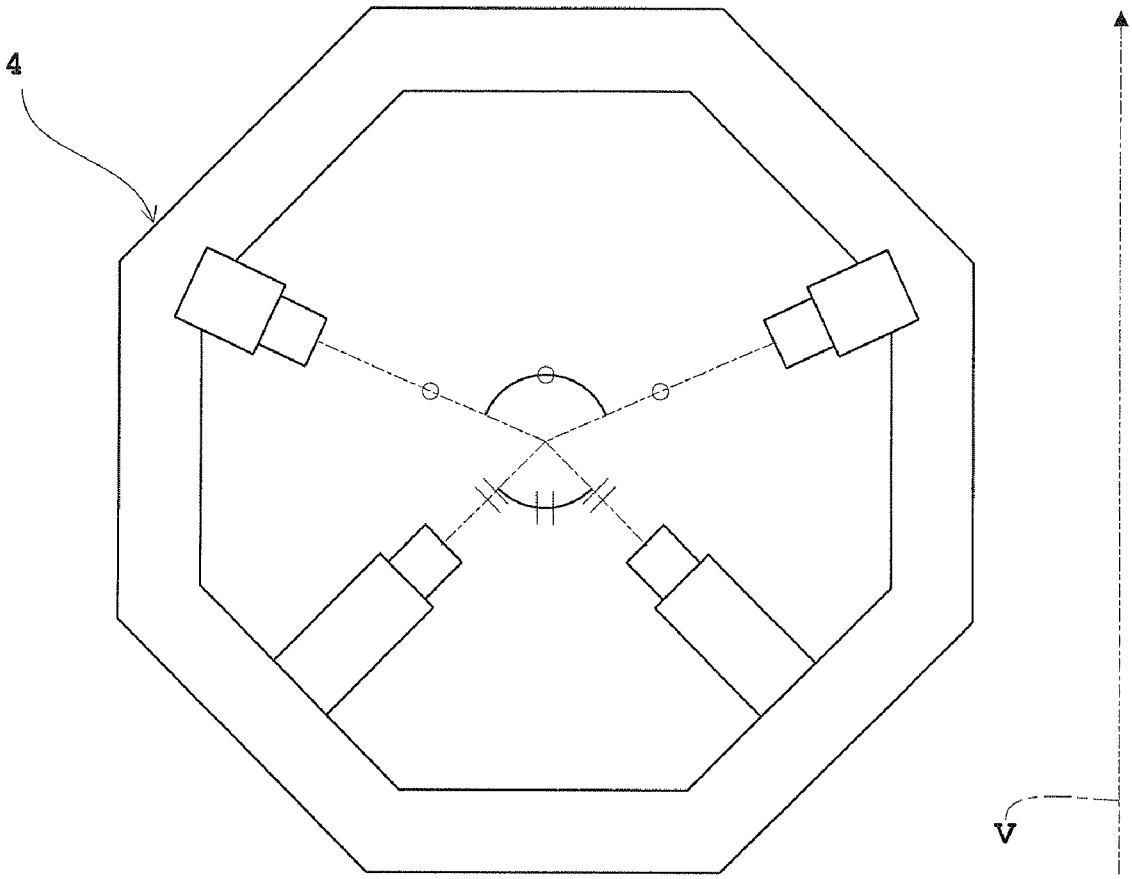
FIG. 7 is a schematic elevation view of the magnetic field generator of the X-ray tube apparatus according to another modification.

(4) In each Embodiment and Modifications (2) and (3) mentioned above, combination of Embodiments 1 and 2, combination of Embodiment 1 and Modifications (2) and (3), combination of Embodiment 2 and Modification (3), and combination of Modifications (2) and (3) has been each described. As illustrated in FIG. 7, Embodiment 2 may be combined with Modification (2). That is, in the magnetic field generator 4, the distribution angle of the magnetic pole may be made to be asymmetrical relative to the deflection direction of the electron beam B, and the length of each magnetic pole may be made to be asymmetrical relative to the deflection direction of the electron beam B.

(5) In each Embodiment and Modification (2) and (3), combination of two examples from each Embodiment and Modifications (2) and (3) has been described as one example. Combination of three or more examples may be made such as combination of Embodiments 1 and 2 and Modification (2), combination of Embodiments 1 and 2 and Modification (3), combination of Embodiment 1 and Modifications (2) and (3), combination of Embodiment 2 and Modifications (2) and (3), or combination of all Embodiments 1 and 2 and Modifications (2) and (3).

(6) In each Embodiment mentioned above, the magnetic field generator (magnetic field generator 4) has been described that includes the polygonal, typically octagonal iron core. The magnetic field generator is not particularly limited in its shape, and may be circular, for example. Moreover, the magnetic field generator is not limited in particular, as is exemplified by the quadrupole magnetic field lens or the octupole magnetic field lens.

The invention claimed is:

1. An X-ray tube apparatus to generate X-rays, comprising a cathode to generate an electron beam, a magnetic field generator to generate a magnetic field for focusing and deflecting the electron beam from the cathode, an anode to generate X-rays upon collision of the electron beam focused and deflected by the magnetic field generator, and an enclosure to accommodate the cathode and the anode inside thereof and rotate together with the anode, wherein the magnetic field generator is arranged so as to be inclined relative to a plane perpendicular to an axis of the electron beam.

2. The X-ray tube apparatus according to claim 1, wherein the magnetic field generator is arranged so as to be inclined relative to the plane perpendicular to the axis of the electron beam within a range in a cathode side from the focused and deflected electron beam.

3. The X-ray tube apparatus according to claim 2, wherein the magnetic field generator is configured such that its inclination relative to the plane perpendicular to the axis of the electron beam is adjustable so that a desired X-ray source diameter may be obtained.

4. The X-ray tube apparatus according to claim 3, wherein the desired X-ray source diameter is a X-ray source diameter reduced by 50%.

5. An X-ray tube apparatus to generate X-rays, comprising a cathode to generate an electron beam, a magnetic field generator to generate a magnetic field for focusing and deflecting the electron beam from the cathode, an anode to generate X-rays upon collision of the electron beam focused and deflected by the magnetic field generator, and an enclosure to accommodate the cathode and the anode inside thereof and rotate together with the anode, in which a distribution angle of a magnetic pole that is formed by each of the magnetic pole of the magnetic field generator is made to be asymmetrical relative to a deflection direction of the electron beam.

6. An X-ray tube apparatus to generate X-rays, comprising a cathode to generate an electron beam, a magnetic field generator to generate a magnetic field for focusing and deflecting the electron beam from the cathode, an anode to generate X-rays upon collision of the electron beam focused and deflected by the magnetic field generator, and an enclosure to accommodate the cathode and the anode inside thereof and rotate together with the anode, in which a length of each magnetic pole of the magnetic field generator is made to be asymmetrical relative to the deflection direction of the electron beam.

7. An X-ray tube apparatus to generate X-rays, comprising a cathode to generate an electron beam, a magnetic field generator to generate a magnetic field for focusing and deflecting the electron beam from the cathode, an anode to generate X-rays upon collision of the electron beam focused and deflected by the magnetic field generator, and an enclosure to accommodate the cathode and the anode inside thereof and rotate together with the anode, in which magnetomotive force to excite the magnetic pole of the magnetic field generator is set to be asymmetrical relative to the deflection direction of the electron beam.

* * * * *